US007533424B2

(12) United States Patent
Symonds-Powell

(10) Patent No.: US 7,533,424 B2
(45) Date of Patent: May 19, 2009

(54) CONVERTIBLE SOCK/SLIPPER LEGWARMER

(76) Inventor: Patricia A. Symonds-Powell, 15033 Dickens St., #104, Sherman Oaks, CA (US) 91403

( * ) Notice: Subject to any disclaimer, the term of this patent is extended or adjusted under 35 U.S.C. 154(b) by 26 days.

(21) Appl. No.: 11/463,221

(22) Filed: Aug. 8, 2006

(65) Prior Publication Data

US 2008/0034477 A1 Feb. 14, 2008

(51) Int. Cl.
*A43B 17/00* (2006.01)

(52) U.S. Cl. ..... 2/239

(58) Field of Classification Search ..... 2/239, 2/242, 80, 83, 269, 270
See application file for complete search history.

(56) References Cited

U.S. PATENT DOCUMENTS 482,095 A * 9/1892 McClurg ..... 66/187
1,112,759 A * 10/1914 Bissell ..... 2/83
1,183,792 A * 5/1916 Aron ..... 2/270
1,283,205 A * 10/1918 Jones ..... 2/83
1,296,442 A 3/1919 Thompson
1,393,900 A * 10/1921 Milkes ..... 2/83
2,131,898 A * 10/1938 Milkes ..... 2/83
2,655,660 A * 10/1953 Racz ..... 2/83
2,775,771 A * 1/1957 Heilbronner ..... 2/270
3,111,676 A * 11/1963 Artzt et al. ..... 2/80
3,201,800 A * 8/1965 McHugh ..... 2/83
3,329,972 A * 7/1967 Schwab et al. ..... 2/239
3,381,311 A * 5/1968 Wormser ..... 2/270
3,975,929 A * 8/1976 Fregeolle ..... 602/63
4,069,515 A * 1/1978 Swallow et al. ..... 2/239
4,181,982 A * 1/1980 Segovia ..... 2/239
4,475,253 A * 10/1984 Laveckis ..... 2/269
D287,366 S 12/1986 Hagen
4,944,041 A * 7/1990 Buenos et al. ..... 2/84
4,961,235 A 10/1990 Williger
5,067,179 A * 11/1991 Wormser ..... 2/269
5,125,117 A * 6/1992 Buenos et al. ..... 2/239
5,133,091 A 7/1992 Del Valle Mas
5,172,427 A * 12/1992 Van Bergen et al. ..... 2/158
5,230,333 A 7/1993 Yates et al.
D351,497 S 10/1994 Yates et al.
5,412,957 A * 5/1995 Bradberry et al. ..... 66/178 A
5,906,007 A * 5/1999 Roberts ..... 2/239
6,047,571 A * 4/2000 Juniman ..... 66/178 A
6,324,698 B1 * 12/2001 Freeman ..... 2/239
6,415,448 B1 * 7/2002 Glogover ..... 2/239
6,839,911 B1 * 1/2005 Mathews ..... 2/93

(Continued)

OTHER PUBLICATIONS

"Trim Fit Sox", Life, Mar. 8, 1948, Top Right Sock.

(Continued)

*Primary Examiner*—Alissa L Hoey
(74) *Attorney, Agent, or Firm*—McDermott Will & Emery LLP

(57) ABSTRACT

Apparel and processes for covering a foot, leg and/or a portion thereof. The apparel may include a sock-like tube made of wearable material that is sized to fit over the foot and the leg. The sock-like tube may have a closed end, an open end, and an opening near but not at the closed end that is sized for the foot to pass through. The processes may include sliding the sock-like tube over the foot and leg while positioning the opening so that it ends up over the top of the foot and moving the toes through the opening.

1 Claim, 5 Drawing Sheets

U.S. PATENT DOCUMENTS

| | | | | |
|---|---|---|---|---|
| 7,007,309 | B1 * | 3/2006 | Mende | 2/239 |
| D544,178 | S * | 6/2007 | Vaughn | D2/747 |
| 2002/0108166 | A1 * | 8/2002 | Abboud | 2/239 |

OTHER PUBLICATIONS

"Visa-Therm Socks Powered by D-Cells", The Sporting Goods Dealer, Aug. 1966, p. 222.

Hosiery & Underwear Jan. 1976 Back Cover top far right tube sock.

Cabela's Fall 1990 p. 105.E(Sock), C(Boot Model).

Heat Factory, Products list printed from website, May 11, 2006, 4 pages.

* cited by examiner

CONVERTIBLE SOCK/SLIPPER LEGWARMER

BACKGROUND

1. Field

This application relates to socks, slippers, and legwarmers.

2. Description of Related Art

A legwarmer may be worn with or without a sock or slipper.

Wearers of socks, slippers and/or a legwarmers, such as dancers, often wish to make changes in the pieces that are worn. For example, a dancer may begin by wearing both a legwarmer and a sock and may then decide to remove the sock. Conversely, a dancer may begin by wearing only a legwarmer and then decide to add a sock. Persons other than dancers may also wish to make similar changes in their wearing attire.

To meet these needs, two separate items must usually be purchased, stored and kept with the wearer: a legwarmer and a sock (or slipper). The need to have these two separate items can create problems. For example, money must be spent on two separate items and there may be problems matching their colors and/or material. It may also be difficult to keep track of a sock (or slipper) that is removed during use, and/or that is needed to be worn after an activity has already started.

SUMMARY

Apparel for covering a foot, leg and/or a portion thereof may include a sock-like tube made of wearable material that is sized to fit over the foot and the leg. The sock-like tube may have a closed end, an open end, and an opening near but not at the closed end that is sized for the foot to pass through.

The opening may extend across approximately half of the sock-like tube.

The opening may be positioned such that, after the sock-like tube is placed over the foot and leg, the opening is behind the beginning of the toes and in the front of the ankle.

The opening may be formed by overlapping portions of material.

The sock-like tube may be constructed from three pieces of material. The three pieces of material may each have a width that is equal to approximately half of the circumference of the sock-like tube. The first piece may have a length that is approximately equal to the length of the sock-like tube. The second piece may have a length that is more than half the length of the sock-like tube but less than the length of the sock-like tube. The third piece may have a length that is less than half of the length of the sock-like tube. The length of the second piece plus the third piece may be greater than the length of the first piece.

Two of the pieces of material may be attached to the third piece but not to each other. The two pieces that are not attached to each other may have an overlapping portion that forms the opening.

The material may be stretchable and elastic.

The apparel may include a pad on the sock-like tube positioned near the closed end of the sock-like tube that has a shape similar to the shape of the bottom of the foot.

The apparel may include two pads on the sock-like tube positioned near the closed end of the sock-like tube such that one resides under the ball and the other under the heel of the foot when the apparel is worn on the foot.

The opening may be on one side of the sock-like tube and the pad or pads may be on the other side of the sock-like tube.

A process for covering a foot, leg and/or a portion thereof with a sock-like tube that is closed at one end, open at the other end, and has an opening near the closed end may include sliding the sock-like tube over the foot and leg while positioning the opening so that it ends up over the top of the foot.

The process may include sliding the toes through the opening and moving the closed end of the sock-like tube back past the beginning of the toes.

The process may include stopping the moving before the closed end is moved past the heel for at least one minute. The process may include moving the closed end of the sock-like tube past the heel before or after the stopping.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

FIG. 7(*b*) illustrates a single pad that may be attached to a sole of the convertible sock/slipper legwarmer illustrated in FIG. 1.

DETAILED DESCRIPTION OF ILLUSTRATIVE EMBODIMENTS

Figure 1:
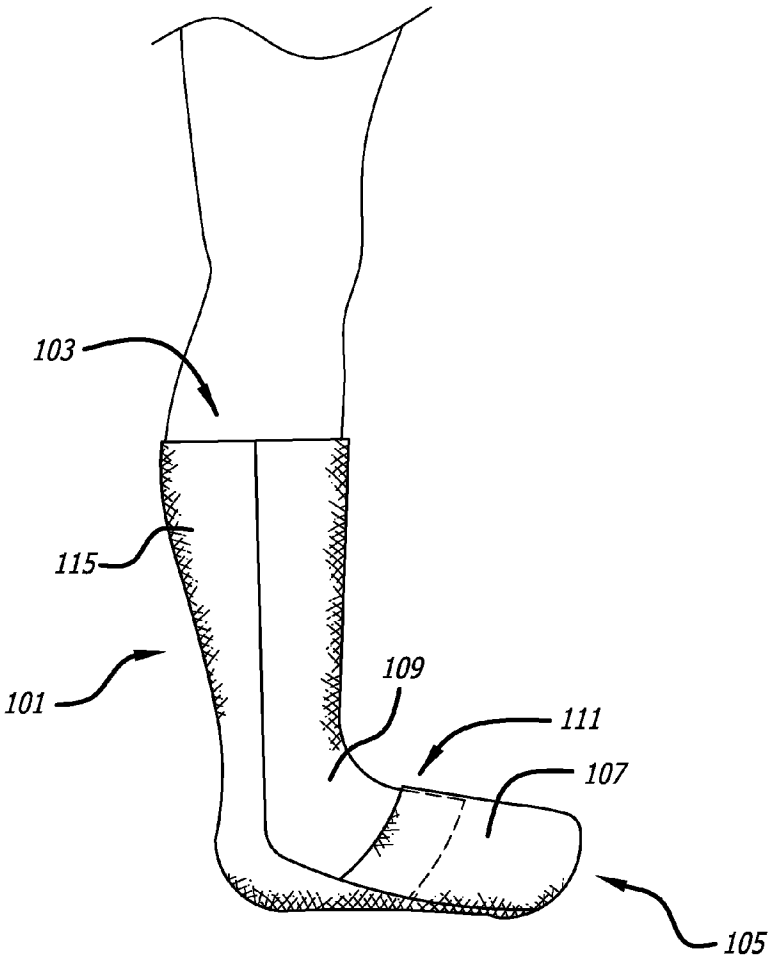
FIG. 1 illustrates a convertible sock/slipper legwarmer fully extended on a foot and leg.

FIG. 1 illustrates a convertible sock/slipper legwarmer fully extended on a foot and leg.

The sock/slipper legwarmer may include a sock-like tube 101 having an open end 103 and a closed end 105.

The sock-like tube 101 may include a lower instep portion 107 overlapping an upper instep/leg portion 109 that may cooperate to form an overlapped opening 111. The sock-like tube 101 may include a rear portion 115. The overlapped opening 111 may extend across approximately half of the sock-like tube 101 and may be located behind the beginning of the toes and in front of the ankle after the sock-like tube 101 is placed over the foot and leg.

The sock-like tube 101 may be placed over the foot and leg by sliding the toes through the open end 103 of the sock-like tube 101 and by then pulling the open end 103 over the instep, over the heel, and up the leg. The open end 103 may be pulled upwardly until the closed end 105 of the sock-like tube reaches the tip of the toes and the material in the sock-like tube is substantial free of wrinkles.

Before sliding the sock-like tube 101 over the foot and leg, the sock-like tube may be oriented so that the overlapped opening 111 will be positioned substantially over the instep of the foot after the foot and leg are fully inserted into the open end 103 of the sock-like tube 101. If a misalignment occurs, the sock-like tube may be rotated while on the foot so as to cause the overlapped opening 111 to be positioned substantially over the instep of the foot.

The sock-like tube 101 may be of any size. For example, it may have a circumference sized to snuggly fit over the foot and leg. It may be uniform in width or vary in width along its length. It may have a length sufficient to cover the ankle when worn. The length may also be sufficient to cover all or only portions of the calf, knee or thigh. The length may be approximately 21 or 27 inches or any other measurement.

The sock-like tube 101 may be made of wearable material that that is stretchable and elastic, such as cotton jersey, polar fleece, knit material, and/or lycra. If sufficiently stretchable and elastic, a sock-like tube of one size may be used for feet and legs of different sizes. The sock-like tube may instead be made and sold in different sizes, such as petite, small, medium, large, extra large, etc. The sock-like tube 101 may be made of fuzzy material for coziness such as yarn.

Figure 2:
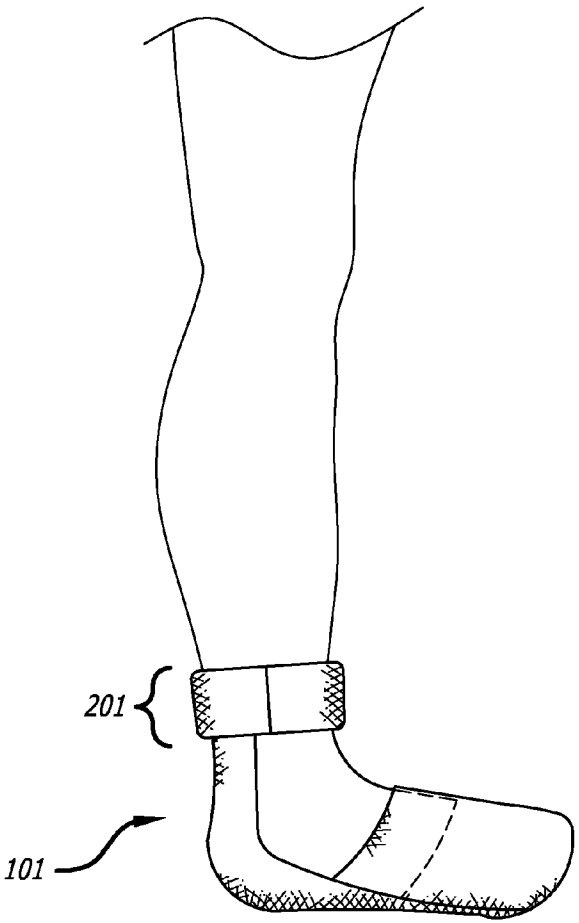
FIG. 2 illustrates the convertible sock/slipper legwarmer illustrated in FIG. 1 with the upper portion being moved down to the area of the ankle.

FIG. 2. illustrates the convertible sock/slipper legwarmer illustrated in FIG. 1 with the upper portion moved down to the area of the ankle. The upper portion may be moved down by rolling it into a rolled ring 201. The upper portion may in addition or instead be simply pushed down, thus causing creases in the material, and/or folded down, in which even a second, outer sub-tube may be formed.

Figure 3:
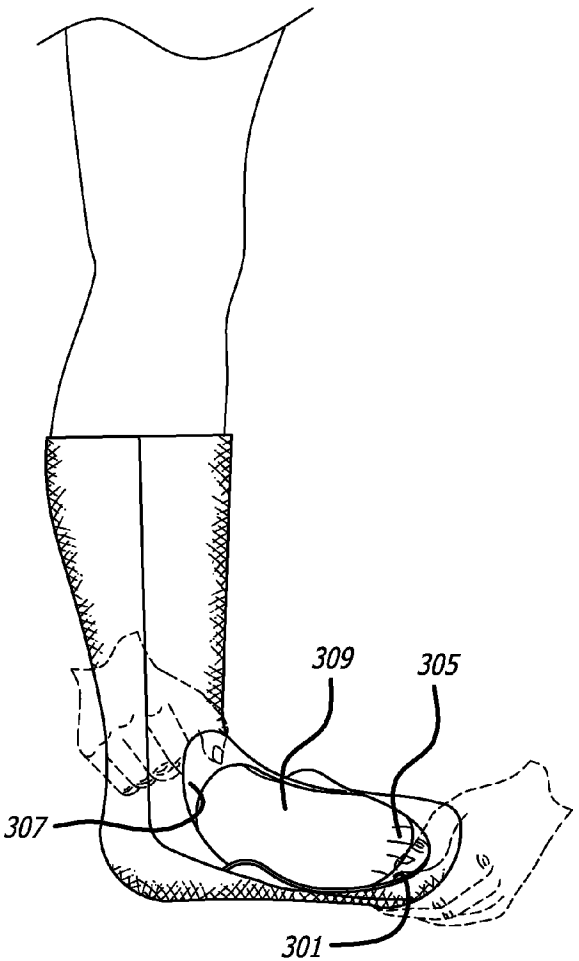
FIG. 3 illustrates the convertible sock/slipper legwarmer illustrated in FIG. 1 with the overlapped opening being pulled apart.

FIG. 3. illustrates the convertible sock/slipper legwarmer illustrated in FIG. 1 with an opening being pulled apart. As shown in FIG. 3, an overlapping lip 301 of the overlapped opening 111 may be pulled downwardly while an underlying lip 307 may be pulled upwardly, thus creating an opening 309 and exposing toes 305. The toes 305 may then be slid through the opening 309, thus causing the overlapping lip 301 and the closed end 105 to travel underneath the toes 305. The material may be sized so that the opening 309 is just large enough to allow the toes 305 to be slid through it during this operation.

Figure 4:
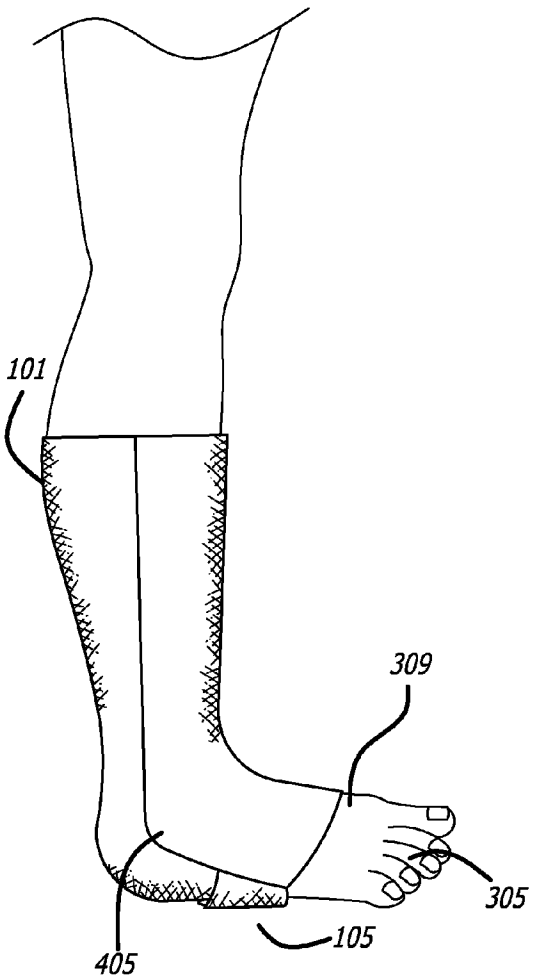
FIG. 4 illustrates the convertible sock/slipper legwarmer illustrated in FIG. 1 with the closed end moved back beyond the beginning of toes but before the front of the ankle.

FIG. 4 illustrates the convertible sock/slipper legwarmer illustrated in FIG. 1 with the closed end moved behind the beginning of toes and in front of the ankle. After sliding the toes through the opening 309, as shown in FIG. 3 and discussed above, the closed end 105 may be rolled, pushed and/or slid back. The closed end 105 may be moved back until it is behind the beginning of the toes but in front of the ankle, as shown in FIG. 4, after which the sock-like tube 101 may be worn for a period of time, such as for more than one minute, without making any further adjustment.

Figure 5:
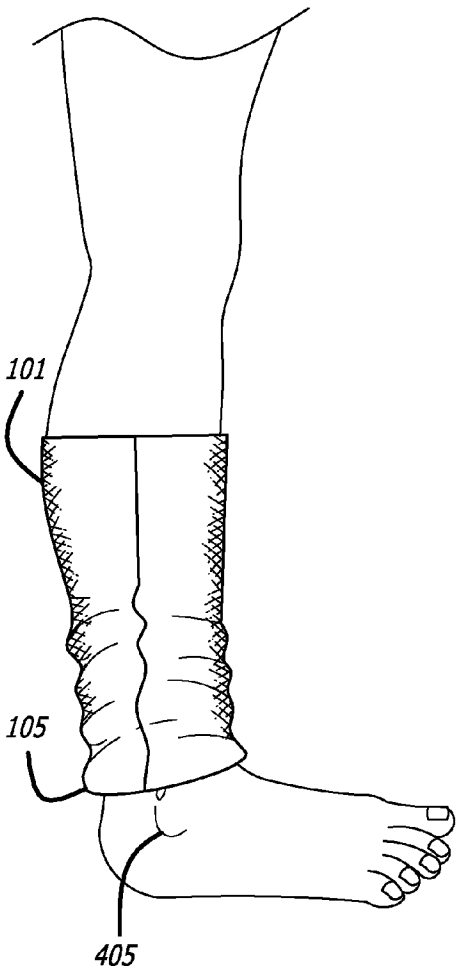
FIG. 5 illustrates the convertible sock/slipper legwarmer illustrated in FIG. 1 with the closed end moved back to approximately the ankle.

FIG. 5 illustrates the convertible sock/slipper legwarmer illustrated in FIG. 1 with the closed end moved back to approximately the ankle. As shown in FIG. 5, the closed end 105 may be rolled, pushed or and/or slid back to approximately the ankle 405. The user may then wear the sock-like tube 101 in this position for a period of time, such as for more than one minute. The user may have moved the sock-like tube 101 into the position shown in FIG. 5 from the position shown in FIG. 1, 2 or 4 or from any other position.

At any time, the user may also move the open end 103 back down the leg, such as to the position shown in FIG. 2.

Figure 6A:
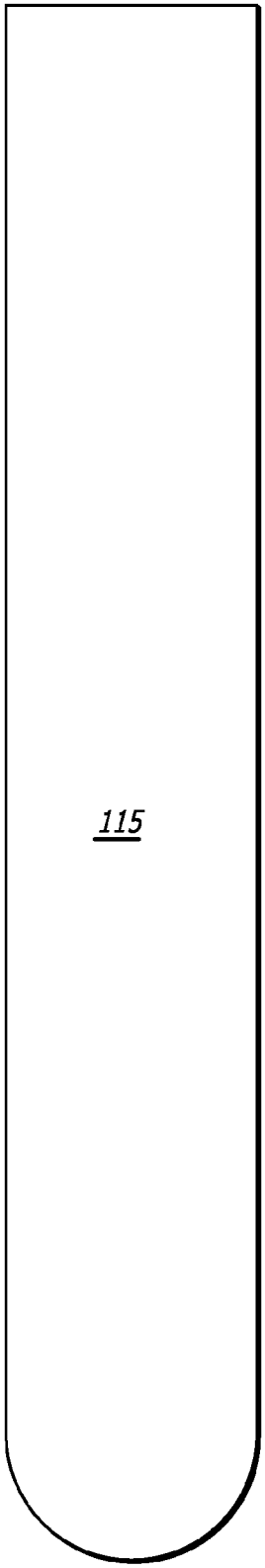
FIGS. 6 (*a*), 6(*b*) and 6(*c*) illustrate three pieces of material that may be used to form the convertible sock/slipper legwarmer illustrated in FIG. 1.
Figure 6B:
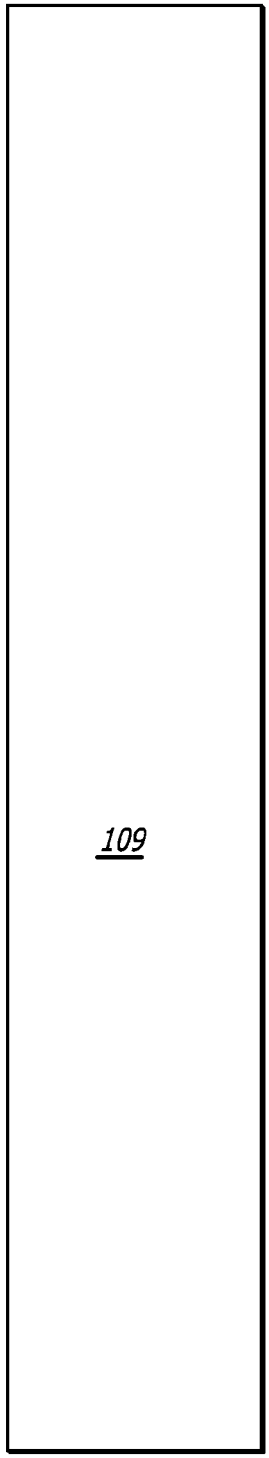
Figure 6C:
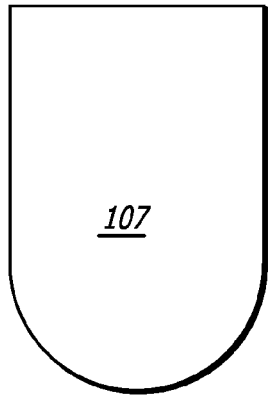

FIGS. 6(*a*), (*b*), and (*c*) illustrate three pieces of material that may be used in the convertible sock/slipper legwarmer illustrated in FIG. 1. They illustrate a shape of material that may be used to form the rear and underfoot portion 115 of the sock-like tube 101, the upper instep/leg portion 109, and the lower instep portion 107.

Each portion of material may have a width that is approximately half of the circumference of the sock-like tube 101. The rear and underfoot portion 115 may have a length that is approximately equal to the length of the sock-like tube 101; the upper instep/leg portion 109 may have a length that is less than the length of the sock-like tube 101 but greater than half of its length; and the lower instep portion 107 may have a length that is less than half of the length of the sock-like tube 101. The sum of the lengths of the upper instep/leg portion 109 and the lower instep portion 107 may be greater than the length of the sock-like tube 101, thus providing the material that may be used to form the overlapped opening 111.

The three pieces of material may be attached in any manner, such as by sewing, glue, heat, or pressure. The upper instep/leg portion 109 and the lower instep portion 107 may be attached to the rear leg and underfoot portion 115 shown in FIG. 6(*a*), but not attached to each other.

Figure 7A:
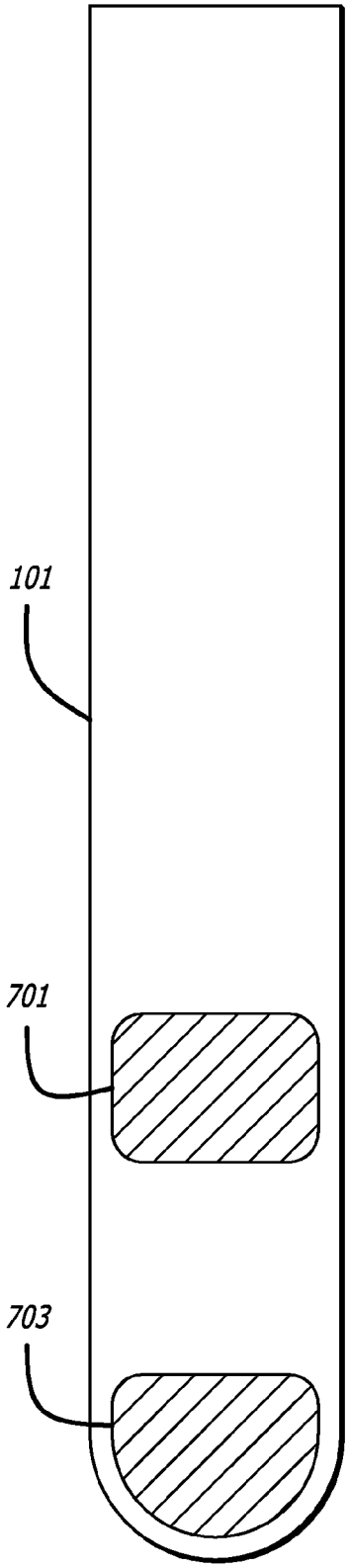
FIG. 7(*a*) illustrates two pads that may be attached to the sole of the convertible sock/slipper legwarmer illustrated in FIG. 1.
Figure 7B:
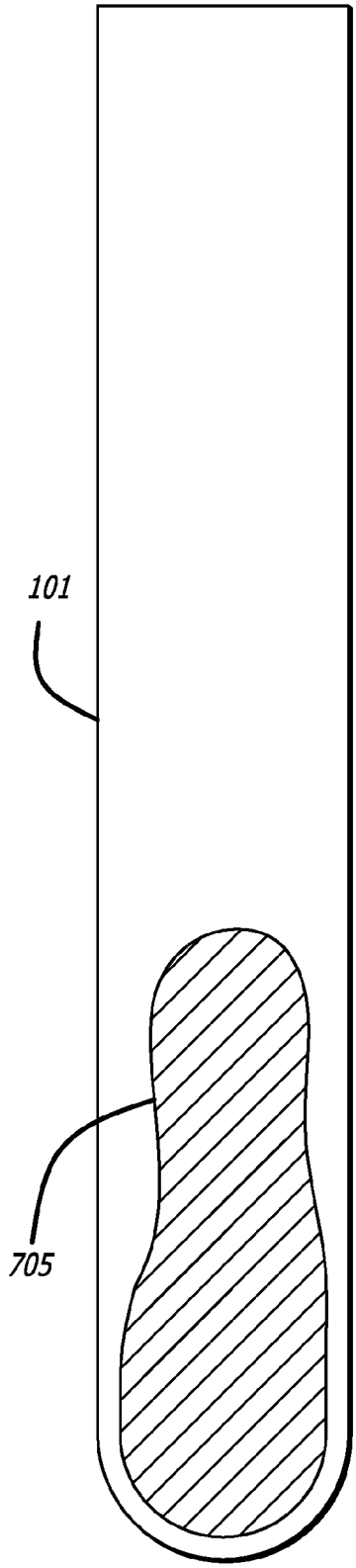

FIG. 7(*a*) illustrates two pads on the sole of the convertible sock/slipper legwarmer that is illustrated in FIG. 1. As shown in FIG. 7(*a*), a pad 701 may be positioned such that it will be under the heel of the foot when the sock-like tube 101 is worn, and a pad 703 may be positioned on the sock-like tube 101 such that it will be under the ball of the foot when the sock-like tube 101 is worn. The pads 701 and 703 may be of any shape, such as a shape that conforms to the portions of the heel and ball of the foot, respectively, that press onto the floor when standing, such as rectangular, oval, circular, or otherwise.

FIG. 7(*b*) illustrates a single pad that may be attached to the sole of the convertible sock/slipper legwarmer illustrated in FIG. 1. As shown in FIG. 7(*b*), a pad 705 may similarly be positioned on the sock-like tube 101 such that it will be under the foot when the sock-like tube 101 is worn. The pad 705 may be of any shape, such as a shape that conforms to the bottom of the foot.

The pads 701, 703, and 705 may be positioned such that they are opposite of the overlapped opening 111. They may be made of any material, such as rubber. They may be of any thickness and rigidity, such as a thickness and rigidity that provides meaningful cushioning to the portions of the foot that will lie over them. The pad rigidity and its thickness may be selected so as to allow the pad to be rolled along with the closed end 105 as it is moved back across the instep of the foot.

The pads 701, 703, and 705 may be affixed to the sock-like tube 101 by any means, such as by sewing, glue, heat, pressure or otherwise.

Figure 8:
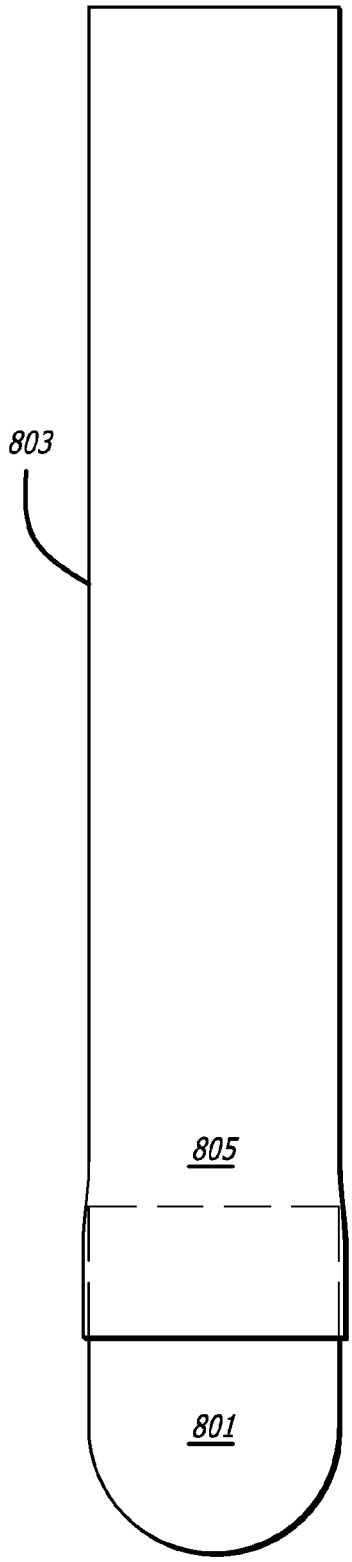
FIG. 8 illustrates an alternate overlapping configuration of an opening in a convertible sock/slipper legwarmer.

FIG. 8 illustrates an alternate overlapping configuration of an opening in a convertible sock/slipper legwarmer. As shown in FIG. 8, a lower instep portion 801 of a sock-like tube 803 may overlap an upper instep/leg portion 805, instead of the toe leg/instep portion overlapping the lower instep portion as is shown in FIG. 1

Figure 9:
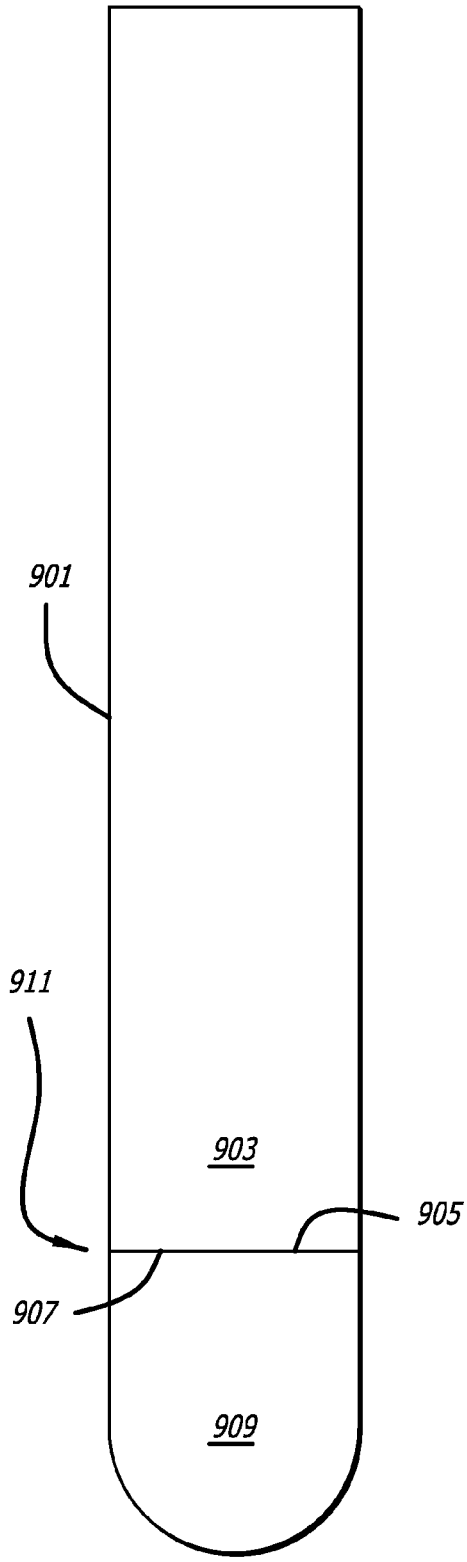
FIG. 9 illustrates an non-overlapping configuration of an opening in a convertible sock/slipper legwarmer.

FIG. 9 illustrates a non-overlapping configuration of an opening in a convertible sock/slipper legwarmer. In this embodiment, a sock-like tube 901 may have an upper instep/leg portion 903 with a lower edge 905 that approximately abuts an upper edge 907 of a lower instep portion 909. An opening 911 that is formed by the abutting edges 905 and 907 may be non-overlapping, in contrast to the overlapping opening shown in FIGS. 1 and 7. Although shown as touching, the upper edge 907 may instead be spaced from the lower edge 905.

The components, steps, features, objects, benefits and advantages that have been discussed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently. In short, the scope of protection is limited solely by the claims that now follow. That scope is intended to be as broad as is reasonably consistent with the language that is used in the claims and to encompass all structural and functional equivalents.

For example, the openings 111 and/or 911 may have a different shape, other than longitudinal, and may be in a different location. Although the sock-like tubes 101, 803, and 901 have thus-far been described as being useful for covering the foot and leg, similarly-configured tubes may be used to cover other appendages, such as the hand and arm. In this embodiment, the opening may be configured so as to end up over the outside or underside of the hand, between the knuckles and wrists, or elsewhere.

The sock-like tubes 101, 803 and/or 901 may include reinforcing in the area of the toes, heel, open end, opening, and/or any other area.

The phrase "means for" when used in a claim embraces the corresponding structure and materials that have been described and their equivalents. Similarly, the phrase "step for" when used in a claim embraces the corresponding acts that have been described and their equivalents. The absence of these phrases means that the claim is not limited to any corresponding structures, materials, or acts.

Nothing that has been stated or illustrated is intended to cause a dedication of any component, step, feature, object, benefit, advantage, or equivalent to the public, regardless of whether it is recited in the claims.

I claim:

1. A tube-like sock that may be worn in four different configurations on a calf and an associated foot having an ankle, toes, a sole with an arch, a heel, an instep, and a ball, the tube-like sock comprising:

a first piece of stretchable and elastic material that is substantially rectangular, except for a front portion that is rounded, and that has a stretched width that is approximately the width of the sole of the foot and a stretched length that is approximately the distance between the end of the toes and the midpoint of the calf;

a second piece of stretchable and elastic material that is not integral with the first piece of material and that is substantially rectangular and that has a stretched width that is approximately the same as the stretched width of the first piece of material and a stretched length that is approximately the distance between the midpoint of the arch and the midpoint of the calf; and a third piece of stretchable and elastic material that is not integral with the first or the second piece of material and that is substantially rectangular, except for a front potion that is substantially rounded, and that has a stretched width that is approximately the same as the stretched width of the first piece of material and a stretched length that is approximately the distance between the mid-point of the arch and the end of the toes, the first, second and third pieces of material are attached to one-another such that:

a squared edge across the width of the first piece of material is substantially aligned with a squared edge across the width of the second piece of material; and the rounded front portion of the first piece of material is substantially aligned with the rounded front portion of the third piece of material;

the first, second, and third pieces of material are attached to one another only along a single seam along the entire perimeter of the first piece of material, except for the squared edge of the first piece of material, thus forming a tube-like sock, the three pieces of material being sized to fit snuggly over the calf and the foot, the three pieces of material are not attached to any other piece of material, the second piece of material is not attached to any other material at either edge of its width, the third piece of material is not attached to any other material at one edge of its width, the three pieces of material form a closed end at the edges of the rounded portions of the first and third pieces of material, an open end at the calf end of the first and second pieces of material, and an overlapping portion between the second and third pieces of material above approximately the mid-point of where the arch of the foot is when the apparel is worn, the overlapping portion forming a closable opening that, when opened, is large enough for the toes, ball, arch, sole, instep, and heel of the foot to pass through, the three pieces of material are sized and attached to one another such that the tube-like sock may be worn in each of the following four different configuration:

a first configuration that completely covers the calf and all of the foot;

a second configuration that completely covers the foot but only a lower portion of the calf a third configuration that completely covers the calf and the foot, except for the toes, without obstructing contact between the ball of the foot and a floor beneath it or substantially bunching up under the arch; and a fourth configuration that completely covers the calf but not any portion of the foot, without substantially bunching up above the ankle.

* * * * *